US005800021A

United States Patent [19]

Derr

[11] Patent Number: 5,800,021

[45] Date of Patent: Sep. 1, 1998

[54] SHINGLE REMOVER AND METHOD OF REMOVING

[75] Inventor: Mark S. Derr, Alburtis, Pa.

[73] Assignee: J. Best Company, Alburtis, Pa.

[21] Appl. No.: 667,976

[22] Filed: Jun. 19, 1996

[51] Int. Cl.[6] ..... E04D 15/02; A47L 11/12

[52] U.S. Cl. ..... 299/37.1; 15/93.1; 30/170

[58] Field of Search ..... 299/37.1; 30/170; 81/45; 15/93.1

[56] References Cited

U.S. PATENT DOCUMENTS

| | | | |
|---|---|---|---|
| 3,542,433 | 11/1970 | Probst | 299/37.1 |
| 3,779,605 | 12/1973 | Nieman | 299/37.1 |
| 4,699,430 | 10/1987 | Nichols | 299/37.1 |
| 4,763,547 | 8/1988 | Dike, Jr | 81/45 |
| 5,001,946 | 3/1991 | Shirlin et al. | 81/45 |
| 5,033,796 | 7/1991 | Odean | 299/37.1 |
| 5,037,160 | 8/1991 | Ukai | 299/37.1 |
| 5,098,165 | 3/1992 | Jacobs et al. | 299/37.1 |
| 5,218,766 | 6/1993 | Himebaugh | 30/170 |

*Primary Examiner*—David J. Bagnell
*Attorney, Agent, or Firm*—Eckert Seamans Cherin & Mellott

[57] ABSTRACT

A shingle remover with a reciprocating material stripping assembly removes roofing shingles and nails with reduced effort. The shingle remover has a metal frame carrying an electric motor coupled to a material stripping tooth assembly for driving reciprocation. The stripping assembly teeth form a wedge-like comb movably retained in the frame and driven by connecting rods attached to a counter-shaft by eccentric mounts. The teeth are laterally spaced only slightly more than the width of a nail shank, forming an inclined lifting surface wherein adjacent teeth engage under the head of nails that are encountered as the shingle remover is advanced, and drives the stripping assembly under the nail heads. The combination of the inclined lifting surface and the reciprocating motion of the material stripping assembly remove the roofing material and lift roofing nails straight out of the roof sheathing.

13 Claims, 4 Drawing Sheets

SHINGLE REMOVER AND METHOD OF REMOVING

BACKGROUND OF THE INVENTION

1. Field of the Invention

The invention relates to the field of construction equipment, and in particular concerns a powered shingle remover for detaching roofing shingles from roofing surfaces, such as fastener-connected shingles in overlapping ranks on a sloping roof.

2. Prior Art

Homes and other structures with inclined or pitched roofs are often protected by shingles. Shingles can comprise asphalt faced with granular stone, wood shakes, tiles of various materials or other shingle units. The shingles are nailed, stapled or otherwise attached to the roof in ranks. Each of the ranks of shingles overlaps the fasteners coupling a next lower rank to the roof, keeping off water. Basic structural support is provided by a rafter system assembled from individual wood studs or pre-formed trusses which define the pitch of the roof. Abutting panels of plywood sheathing or the like are attached to the rafters and provide a continuous deck. Felt paper or tar paper is disposed on the sheathing and can be stapled in wide horizontally-elongated strips wherein a short edge of each higher strip overlaps a lower strip. A layer of roofing shingles is nailed to the roof deck over the felt, using galvanized roofing nails or the like. Flashing of metal, rubber, plastic or other material is provided at key roof intersections, such as at the junction between the roof and a chimney, at the bottoms of valleys formed between adjacent roof decks of different pitch, around skylights and ventilation openings, or at the junction of the roof deck and a vertical wall.

Over time with weathering and sunshine, the shingles deteriorate. To renew a shingle roof it is possible to treat an existing roof as if it were a deck, and simply to cover the old shingles with a layer of new ones. However, it is advantageous and sometimes necessary to remove the old shingles before installing new ones. Removal of old roofing materials prior to re-roofing provides a flat deck surface to receive new shingles such that they can lay flat on one another. An old shingle roof may be uneven and lumpy from wear, which keeps the new shingles from lying as flat. Inspection and replacement of any water-damaged or rotted sheathing requires that the sheathing be exposed to view. Old flashing can be replaced. The roof can be updated to include new materials and new forms of fittings, more or better flashing to prevent leakage, ridge vents to provide better ventilation and so forth. In addition to the fact that a wholly new shingle roof (i.e., one mounted on a clear deck) protects the building more effectively than a layered-over roof, a new roof is also lighter. Local building codes may prohibit installation of more than two layers of overlapping roofing material as a safety hazard.

Old layers of shingles can be removed using a shovel, pitch fork, various types of crow bars for extracting nails, and considerable manual labor. Typically, the shingles and felt or tar paper are pried up leaving many of the nails in the sheathing, which nails are then removed. Manually stripping a roof of shingles contributes a significant portion of the cost of re-roofing due to the labor required. This phase of the work is also time consuming, particularly because it is not advisable to have more than a few workers together on the roof deck at a time, due to weight.

Several attempts have been made to automate or assist in the job of detaching a surface covering from an underlying deck or base. U.S. Pat. No. 5,037,160—Ukai a machine resembling a bulldozer with a stripping blade, used to remove flooring materials. U.S. Pat. No. 5,033,796—Odean discloses a powered floor stripper with an oscillating stripping blade. These machines are impracticable for use on many roof surfaces due to their size and weight, which makes them difficult to deploy and prone to damage the roof deck (especially the sheathing). Such a device would also be dangerous because its high center of gravity could cause it to tip on a pitched roof surface.

U.S. Pat. No. 5,098,165—Jacobs et al. discloses a self propelled movably tethered shingle removing machine. The device has a metal track that is secured along the roof peak and a carriage movable along the rack. The carriage has a ratchet winch for setting a length of cable and the cable tethers a self-propelled machine to the carriage while permitting the machine to move over the roof below the roof peak. The wheeled machine has an electric motor coupled to a shingle stripping blade by a pair of drive arms moved by a cam shaft. The cam shaft is chain driven by the electric motor and causes the blade assembly to reciprocate.

By changing the position of the carriage along the rack and the length of cable, the wheeled machine frame is guided over different areas of the roof, in successive paths that are parallel to the roof peak, while removing horizontal ranks or strips of roofing materials via the blade, which is advanced and lifted in an oscillating manner by the cam arrangement. Jacobs et al. cable guidance system addresses potential problems with maintaining a desired position on the roof. However, this system requires carrying a number of relatively large items up to the roof top and rather extensive steps to mount and set up the parts.

U.S. Pat. No. 4,699,430—Nichols discloses a somewhat smaller material stripper used without a guide system. This material stripper has a metal frame and an electric motor coupled to a lifting plate and an actuator. The lifting plate is coupled to the electric motor via a belt and eccentric cam arrangement which oscillate the lifting plate as it is advanced under a shingle, thereby lifting the shingle from the roof deck. The lifting plate is thin and flat at the front and has several large spaced teeth, which structure apparently facilitates getting the lifting plate under the roofing material.

U.S. Pat. No. 4,763,547—Dike Jr. Discloses a shingle removing too which is pneumatically operated. The tool has a power head with a pivoting lifting plate. A pneumatically operated piston pivots the lifting plate in duck bill fashion for prying shingle materials from the roof.

Proper removal of old roofing involves the complete removal of old shingles, felt or tar paper, and fasteners such as nails. Nails are a problem. It is possible to rip up shingles without pulling their nails cleanly from the sheathing. The nails then retain felt paper and bits of shingle, requiring individual attention. Some nails become bent over instead of being removed. Nails may be displaced laterally in the plane of the roof surface, enlarging their nail hole and damaging the sheathing. Nails that are cut or broken off, bent down or simply damaged as to their nail head become difficult to find or to remove, and if not removed may damage the new roofing. The devices disclosed in the foregoing patents are capable of assisting in the removal of surface materials or roofing to some degree. However, each inherently results in incomplete removal of the old roofing materials in that each is deficient as to convenient and relatively complete extraction of nails.

Manual extraction of nails, including roofing nails, is known in the art. Typically nails are removed with a tool such as a pry bar, claw hammer or the like, having a lever arm, fulcrum and a tapering groove or a crows foot forming lifting surfaces separated by a tapered groove for closely engaging the shaft of the nail. The crows foot preferably is placed under the head of nail so that the nail shank is engaged in the groove and the lifting surfaces engage the underside of the nail head. It is desirable to force the crows foot under the nail head as far as possible, positively engaging the crows foot under the nail head and wedging the nail shank into the groove. This minimizes the possibility that the nail head will fail during extraction.

After engaging the shank in the crows foot, the lever arm of the tool is moved towards the roof deck causing the pry bar to pivot on the fulcrum and lifting the nail away from the roof deck by its head and shank, generally in a direction perpendicular to the plane of the roof. When the nail has been removed it may remain stuck in the crows foot, the shank of the nail being wedged in the tapered groove, and must be pried from the groove as a further step, before the crows foot can properly engage another nail.

In order to minimize damage to the roof deck it is important to pull the nail straight out of the roof deck, i.e., in a direction co-axial with the direction that the nail was driven into the roof deck, typically perpendicular to the plane of the deck. This minimizes damage to the roof deck, leaving only the existing nail hole. It is also important to engage the lifting surfaces closely with the shank, particularly so that the lifting surfaces are immediately adjacent to the shank when bearing under opposite sides of the nail head. This prevents slippage of the pry bar and damage to the nail head that may make subsequent removal attempts more difficult.

Common roofing nails have relatively large heads in proportion to their shanks, and are often treated or made of a material having anti-corrosion properties. For example, a common roofing nail is formed from relatively malleable metal, may be galvanized, and has a shank diameter of about 3 mm, a head diameter of about 9 mm and range from 4.0 cm to 8.0 cm in length. The large nail head typically has a non-uniform thickness of 1 mm or slightly less. In combination with the soft metal composition, the large thin structure of the nail head is inherently weak and prone to damage. Thus with roofing nails in particular, it is important to engage the crows foot fully against the nail shank such that both lifting surfaces engage under the nail head on opposite sides of the nail shank, to minimize the possibility that the nails head will fail structurally during extraction.

It would be desirable to have an automated shingle removing device that can remove old roofing materials as completely and conveniently as possible, especially including nails. It would also be desirable to have an automated shingle removing device that can remove nails with a minimum of misses that leave the nail in the deck with damage to the nail head. It would also be desirable to have an automated shingle removing device which can remove old roofing nails without clogging or jamming.

SUMMARY OF THE INVENTION

It is an object of the invention to provide an automated shingle removing device which is advantageous for use on pitched roofs.

It is also an object of the invention to provide an automated shingle removing device which is relatively light in weight and has a low center of gravity.

It is another object of the invention to provide an automated shingle removing device which has a plurality of reciprocating teeth formed with lifting surfaces operable to engage a roofing nail head closely on opposite sides of the nail shank.

It is another object of the invention to provide an automated shingle removing device which has a plurality of reciprocating teeth formed with lifting surfaces operable to lift a roofing nail straight upwardly out of the sheathing.

It is yet another object of the invention to provide an automated shingle removing device which has a plurality of substantially parallel reciprocating teeth which are operable to remove roofing nails without clogging or jamming during use.

These and other objects are accomplished by a motorized shingle remover with reciprocating material stripping assembly which remove shingles and roofing nails with reduced effort. The shingle remover has a metal frame to which an electric motor is attached. The material stripping assembly has a plurality of teeth arranged in comb like fashion. The material stripping assembly is movably retained in the metal frame and is driven by connecting rods. The connecting rods are attached to a counter-shaft, and the counter-shaft is belt driven by the electric motor.

The individual teeth of the material stripping assembly are spaced apart sufficiently so that the shank of a common roofing nail can just pass between successive teeth. The teeth have an inclined upper lifting surface to engage the underside of each nail head they encounter. Pairs of adjacent teeth function in concert to provide a pair of lifting surfaces which engage the underside of a nail head close to the shank, yet are spaced apart sufficiently that the nail shank can pass freely between them. Thus the pairs of adjacent teeth do not become clogged.

The reciprocating material stripping assembly according to the invention can be used to clear strips of roofing in a vertical, horizontal or other path, but is advantageously used in a vertically downward path with some assistance from gravity, to clear successive vertically elongated strips. First the leading edge of the teeth is wedged under the roofing material near the roof peak. The forward/rearward reciprocating action of the wedge-like material stripping assembly drives the teeth forward, passing under the roofing material as the invention travels along the roof deck. Each nail encountered passes into the gap between two adjacent teeth as the invention advances along the roof deck. As the teeth advance further, the lifting surfaces on the upper sides of the two adjacent teeth engage the underside of the nail head on opposite sides of the nail shank. The combination of the inclined lifting surface and the reciprocating motion of the nail remover lift the nails straight out of the sheathing. The shingle remover also has a cover assembly which mounted to the frame at the same angle as the inclined lifting surface so that removed roofing materials pass easily over the frame and do not become pile up or become jammed on the frame.

Once the shingle remover advances to the lower edge of the roof, it can be moved back to the roof peak and the process is repeated for another vertical strip until all of the roofing materials, including the nails, are removed. Once detached from the roof deck, the old roofing materials are easily disposed of by conventional means.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
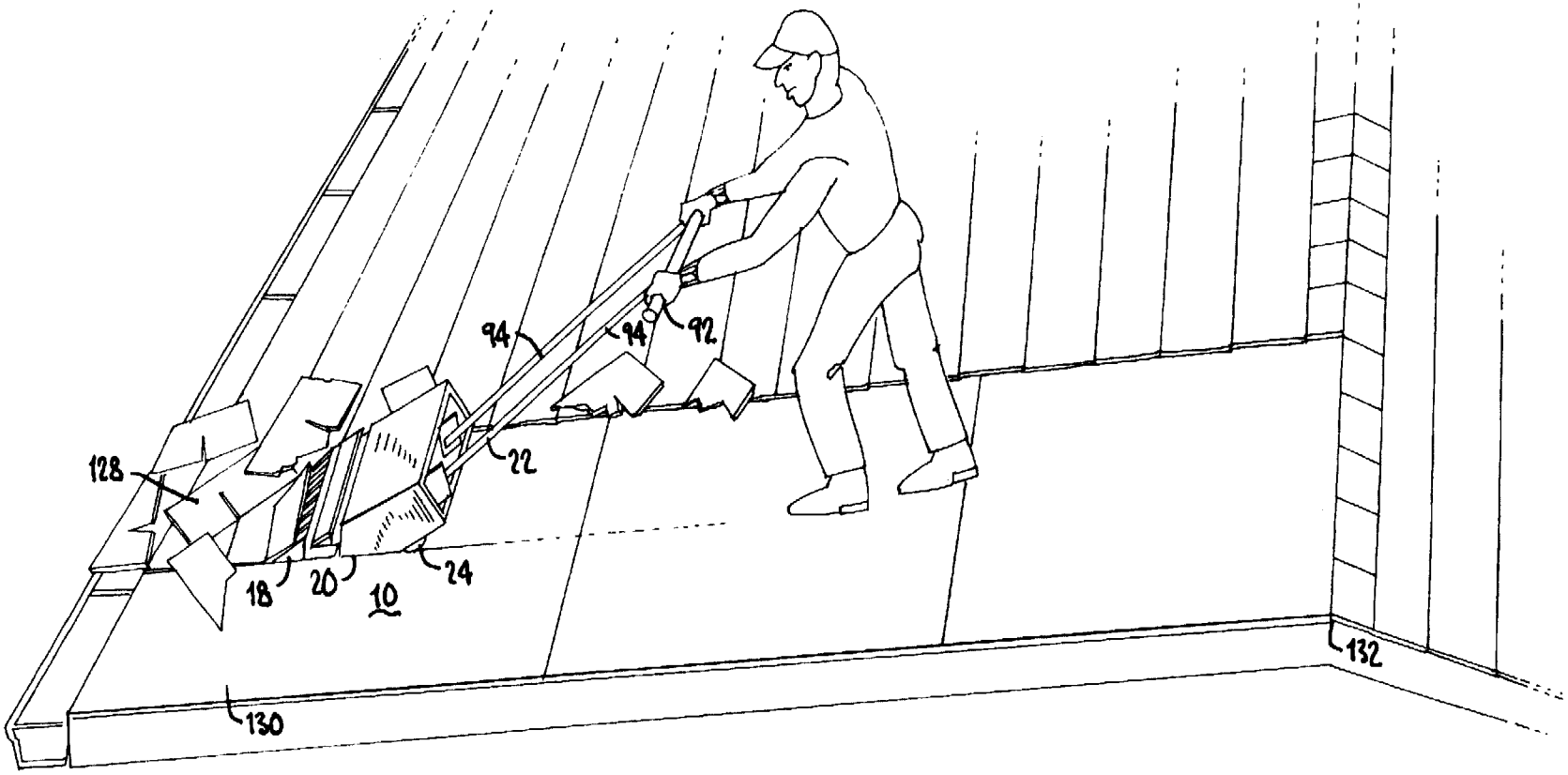
FIG. 1 is pictorial view of the shingle remover in use on a pitched roof.
Figure 2:
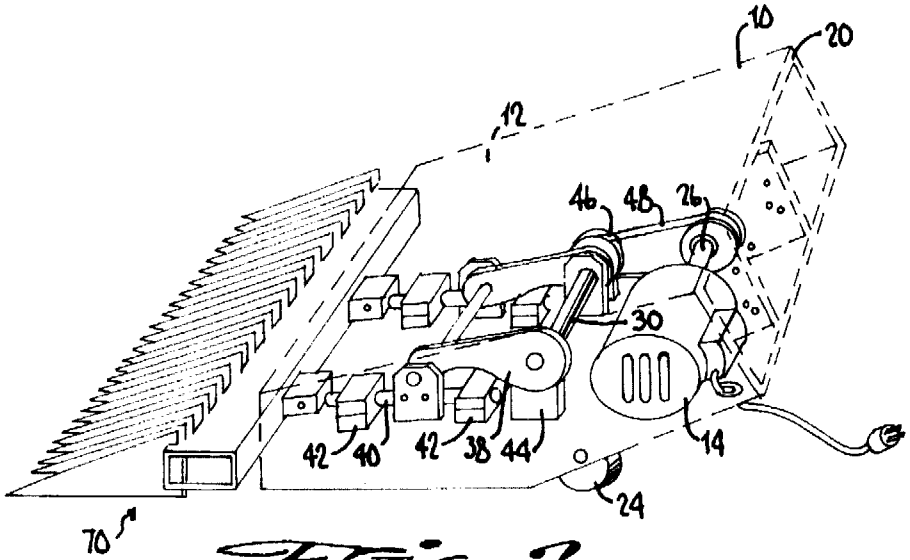
FIG. 2 is a pictorial view of the shingle remover as viewed from the side.
Figure 7:
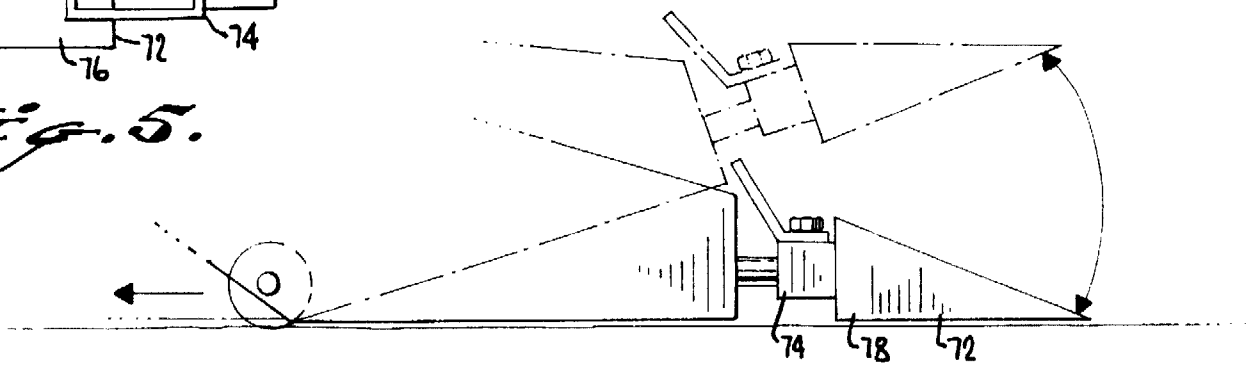
FIG. 7 is a partial side view of the shingle remover showing the guide wheel.

The shingle remover 10 as shown generally in FIG. 1 and partially in phantom in FIG. 2, has a metal frame 12 to which a motor 14 is mounted, a driver 16 coupled between the motor and a material stripping assembly 18 for reciprocating stripping assembly 18 forward and backward, a cover assembly 20, a handle 22 (FIG. 1) and guide rollers 24. The frame as shown generally comprises a flat metal pan. The metal pan can include strengthening ribs or folds to add structural rigidity. Alternatively, the frame can be constructed from straight or curved bar stock coupled to form a generally rigid rectangular base for mounting the mechanical components of the shingle remover. The guide rollers 24 are located at the rear of the frame and allow for easy movement and positioning of the shingle remover by tipping it onto the rollers as shown in FIG. 7.

Figure 4:
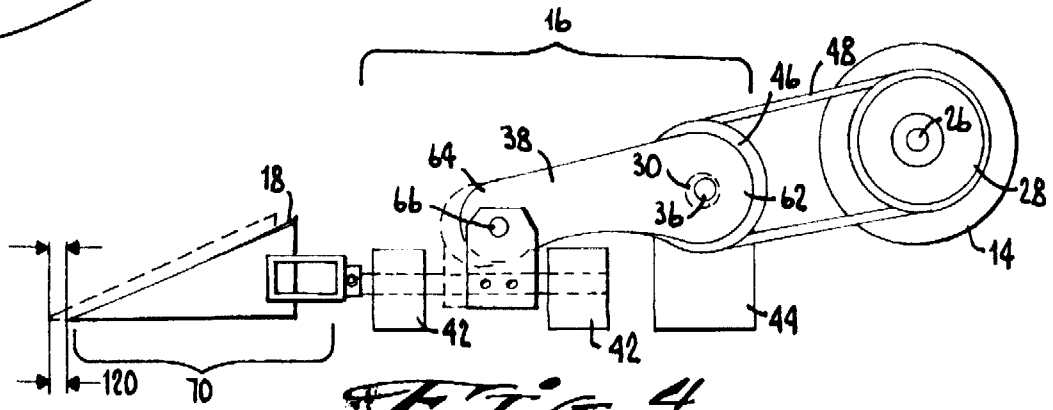
FIG. 4 is a side view of the motor, reciprocating assembly and material stripping assembly.

As shown in FIGS. 2 and 4, motor 14 has an output shaft 26 to which a motor pulley 28 is attached by conventional means such as a non-round contour, a notch or keyway with shaft key (not shown), transverse coupling pin, setscrew, etc., so as to rotate with shaft 26.

The driver for reciprocation of the stripping assembly 18 has a counter-shaft 30, the opposite ends of which have eccentric mounts 36. A pair of connecting rods 38 are coupled to the eccentric mounts, and a pair of push rods 40 are coupled to the connecting rods. The push rods 40 are supported by a pair of linear support bearings 42.

The counter-shaft is preferably formed from metal bar stock and is rotatably mounted to the frame via a pair of bearing supports 44 which carry bearings such as sleeve bearings or sealed ball bearings. The counter-shaft has an attached pulley 46 rotationally fixed to the counter-shaft, for example by a keyway or set screw as discussed above. Pulley 46, and therefore counter-shaft 30, are coupled to the motor 14 via a belt 48 on motor pulley 28. The rotational speed of the counter-shaft and the reciprocation period are a function of the ratio of the pulley diameters multiplied by the rotational speed of the motor (i.e., counter-shaft rotational speed=[motor pulley diameter/counter-shaft pulley diameter]*motor rotational speed). The motor and counter-shaft pulleys 28, 46 as shown in FIG. 4 are identical in diameter such that the rotational speed of the counter-shaft as the same as that of the motor, but this can be varied. According to a preferred arrangement, the motor has a rotational speed in the range of 1725–3450 rpm.

Figures 8, 9, 10:
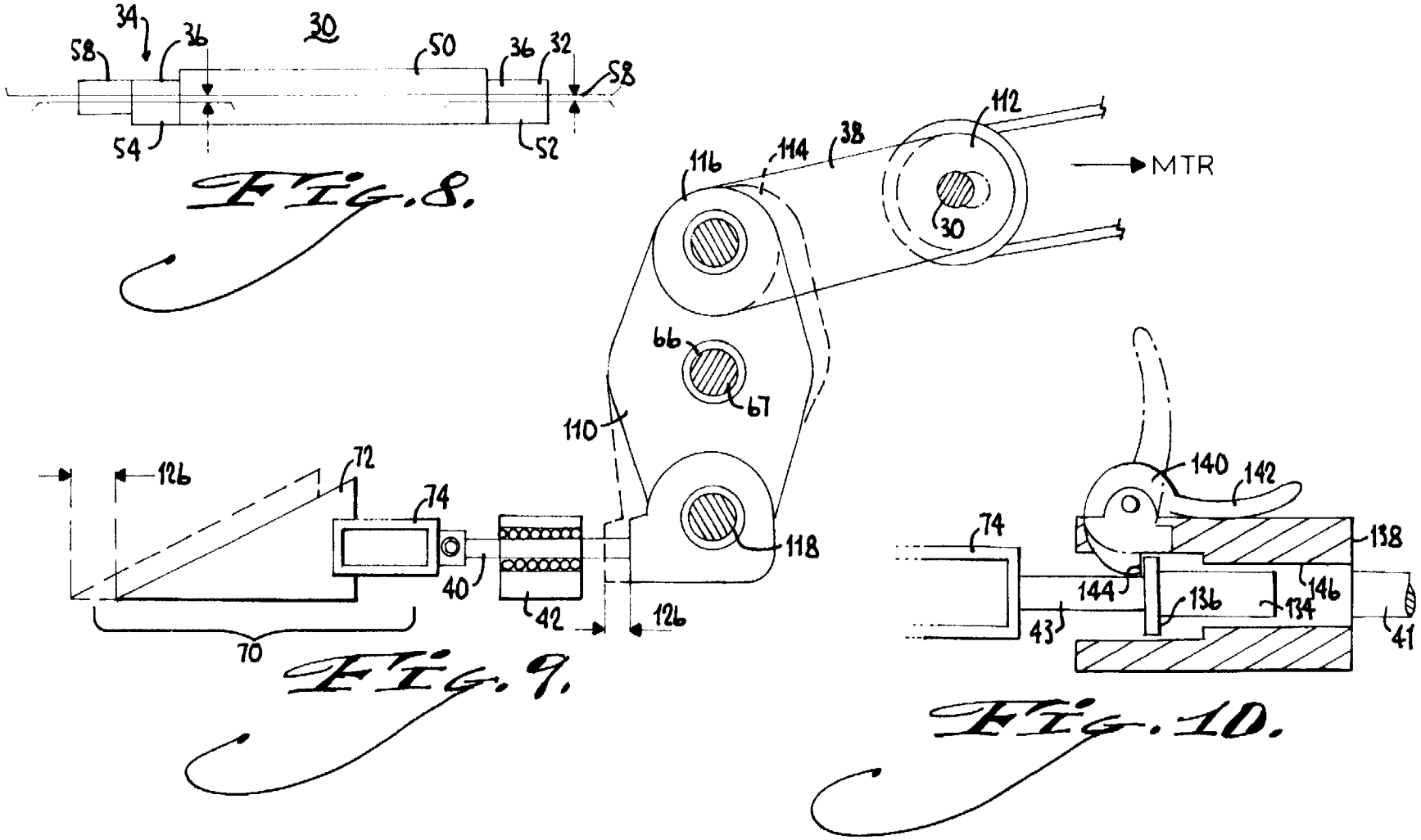
FIG. 8 is a side view of the counter-shaft.
FIG. 9 is a side view of an alternative embodiment of the invention showing a rocker assembly for providing a counter-balanced assembly.
FIG. 10 is a side view of an alternative embodiment of the invention showing a telescopic coupling member for movably attaching the material stripping assembly.

FIG. 8 shows a detailed view of counter-shaft 30 and an exemplary eccentric mount 36 for the counter-shaft. The two opposite eccentric mounts 36 are preferably machined directly into the profile of the metal bar stock. The counter-shaft has a counter shaft axis, 58, a shaft body 50, first and second eccentric cam surfaces 52, 54, and a machined surface 56 for the counter-shaft pulley. The machined surface for the counter-shaft pulley is coaxial with the counter shaft axis 58.

Figure 3:
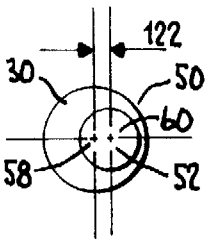
FIG. 3 is a plan view of the eccentric cam.

As shown in FIGS. 3 and 8, the opposite eccentric mounts have a common eccentric axis 60, the cam surfaces 52, 54 being coaxial to the eccentric axis. The eccentric axis has an offset 122 from the counter-shaft axis. In the preferred embodiment the eccentric axis offset 122 is approximately 5 mm (approximately 3/16 inch). Alternatively, the eccentric mounts can be separately provided and coupled to the counter-shaft, being angularly fixed to the counter-shaft instead of integral therewith.

Connecting rods 38 have a drive end 62 that moves in a circle due to eccentric mounts 36, and a driven end 64 that moves linearly due to attachment to push rods 40 in bearings 42. A secondary shaft 66 couples push rods 40 to connecting rods 38 via push rod mounts 68, which are rigidly attached to the push rods and rotatably attached to the secondary shaft 66. Preferably, the drive and driven ends of connecting rods 38 have sealed bearing assemblies to minimize friction during operation.

Figure 5:
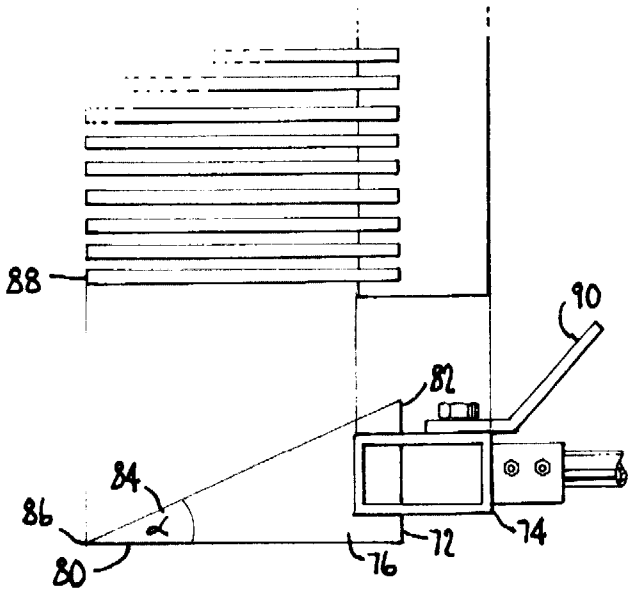
FIG. 5 is combination partial side view and partial plan view showing the structure of the teeth and mounting bar.

A material stripping assembly 70 is coupled to push rods 40 at the forward end of the machine. The material stripping assembly has a plurality of teeth 72 coupled to a mounting bar 74. The teeth as shown in FIGS. 2 and 5 are substantially identical to one another, comprising generally triangular plates. The teeth plates can be heavy sheet metal stock, or alternatively can be formed from another rigid or semi-rigid material. The teeth plates can be stamped, cut from sheet stock, cast, molded or forged.

The teeth have a first and second opposite sides or faces 76, 78, which are parallel and spaced by the thickness of the material, a first or lower edge 80, a second or rear edge 82, and an inclined third edge 84. Preferably the teeth taper to a point 86 at the intersection of the first edge 80 and the third edge 84, defining a wedge or lifting angle $\alpha$ which preferably ranges from approximately 15° to 45°. The inclined third edge 84, which advances and retracts in a reciprocating motion, defines a lifting surface 88 with a width defined by the thickness of the teeth.

The preferred thickness and spacing of the teeth and their lifting surfaces are determined by the size of the nail to be extracted. Preferably, the gap between adjacent teeth is only slightly greater than the width of the nail shank, and the width of each tooth corresponds to the span of the nail head measured radially from the shank. As a result, the teeth fully support the nail head, and are spaced as closely to one another as possible. A common galvanized nail, for example, has a 9 mm diameter head and a 3 mm shank, such that the annular bearing surface under the nail head is approximately 3 mm in measured radially (approximately 1/8 inch). It is desirable to provide teeth with a thickness of at least 3 mm to fully support the nail head of this type of common nail, and preferably only that thickness so that the slots between adjacent teeth are of maximum density. For extraction of other size nails the thickness of the lifting surface can be adjusted accordingly.

The lifting angle a is preferably set at approximately 27°, which is optimal for removing from plywood decking standard galvanized nails having a 9 mm diameter head and a 3 mm shank. A smaller lifting angle provides more leverage or mechanical advantage in lifting nails from the roof deck but sacrifices strength at the point. A larger lifting angle produces a stronger point but less leverage or mechanical advantage. A lifting angle of approximately 27° produces a good compromise between leverage and point strength.

In FIG. 5, a plurality of teeth are coupled to the mounting bar 74 at their rear edges 82 in comb like configuration. The adjacent teeth are generally parallel and spaced, forming parallel gaps for receiving nail shanks. The width of each gap is ideally set just slightly wider than the diameter of the nail shank. For example, a 5 mm (approximately 3/16 inch) gap is preferable for removal of standard galvanized nails having a 9 mm diameter head and a 3 mm shank. For nails having a larger or smaller diameter shank, the gap can be widened or narrowed accordingly.

A deflector 90 is attached to the material stripping assembly 70 using conventional fasteners as shown in FIGS. 1, 5 and 7. For clarity, the deflector is not shown in FIGS. 2 and 4. The deflector assembly is preferably formed from sheet stock and guides roofing material over the front edge of the cover assembly 20 as the roofing material is removed. The cover assembly is mounted to the frame and is angularly disposed, for example at the lifting angle of the teeth, so that removed roofing materials pass easily over the frame and do not pile up over the teeth or become jammed at the front of the frame.

Figure 6:
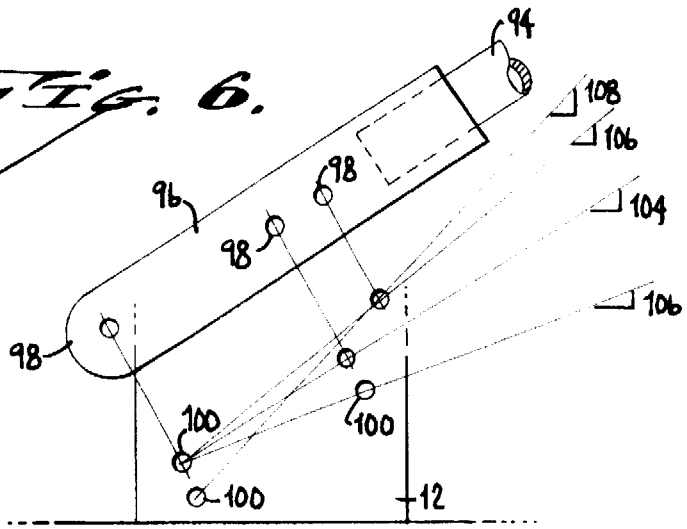
FIG. 6 is a partial side view showing the multiple mounting holes for adjustable mounting of the handle.

The apparatus also comprises a handle assembly 22 as shown in FIG. 1, with a push bar 92 and a pair of rails 94 to which mounting blocks 96 are attached (FIG. 6). The mounting blocks 96 are formed with a plurality of adjustment holes 98 which engage complementary mounting holes 100 formed in the frame 12. The handle 22 is attached to the frame by conventional methods such as bolts passing through the respective adjustment holes 98, 100. Aligning the adjustment holes in the various positions 102, 104, 106, 108, shown in FIG. 6 provides a range of angular settings at which the handle can be fixed relative to the frame so that the operator maintains a comfortable position in operating the shingle remover. This adjustment may be appropriate to suit users of different heights or to suit a given user operating the machine on roofs of different pitch.

As shown in FIG. 2, motor 14 is an electric motor which is connectable by an electric cord to a power source (not shown). The motor drives counter-shaft 30 via pulleys 28, 46 and belt 48. In the embodiment shown, the counter-shaft and the eccentric mounts rotate at the same rotational speed as the motor. The push rods are rotatably coupled to the eccentric mounts and reciprocate with a stroke as shown in 120 FIG. 4, namely twice the eccentric axis offset 122 (preferably approximately 10 mm).

In the alternative embodiment shown in FIG. 9, the means for reciprocation is balanced to minimize vibration. The same reference numbers are used throughout the drawings to identify corresponding parts. Counter-balancing is achieved by providing a rocker assembly 110 such that the connecting rods 38 and push rods 40 oppose each other during operation. A first end 112 of each of the connecting rods 38 is coupled to eccentric counter-shaft 30 as discussed above. The second end 114 of each connecting rod is rotatably coupled to the upper mount 116 of a rocker assembly. Secondary shaft 66 is supported by bearing supports (not shown) in a manner similar to the counter-shaft. The rocker assembly rotates or pivots about the secondary shaft axis 67 or pivot point. The push rods are rotatably coupled to the lower mount 118 of the rocker assembly. The push rods are movably coupled to the frame, being supported by linear support bearings 42 as discussed above.

Forward motion of the connecting rods 38 pivots the rocker assembly 110, causing the push rods 40 to move in the opposite direction. Counter-balancing is optimized by matching the combined mass of the push rods and material stripping assembly to the combined mass of the connecting rods. FIG. 9 shows the general arrangement of components required for counter-balancing. Substantially larger and more massive push rods are required to compensate for the combined mass of the push rods and material stripping assembly.

The rocker assembly as shown has upper and lower mounts 116, 188, which in the embodiment shown are equally spaced from the secondary shaft axis 124. The push rod stroke 126 is not only defined by the eccentric offset as discussed above but also depends on the ratio of the lower mount and upper mount spacing (i.e., push rod stroke= [lower mount spacing/upper mount spacing]*connecting rod stroke). With both upper and lower mount being equally spaced from the pivot point (secondary axis) the rocker ratio as defined above is 1:1. Therefore, the stroke of the connecting rods and push rods will be equal and opposite. In the alternative, the upper and lower mounts can be relocated, having different spacing from the secondary shaft axis thereby changing the rocker ratio as well as the mechanical advantage and stroke length. Providing a larger spacing for the upper mount will produce a smaller push rod stroke. Providing a smaller spacing for the upper mount will produce a larger push rod stroke.

FIG. 10 shows an alternate mounting arrangement for the material stripping assembly. The material stripping assembly is telescopically mounted via primary and secondary push rods and a telescopic mount so that the back-and-forth reciprocating motion of the primary push rods is converted into repeated forwarded motion of the secondary push rods and material stripping assembly. Telescopic couplings as depicted in FIG. 10 are known in the construction trade as applied to jackhammers and the like. Secondary push rod 43 is coupled on one end to the mounting bar 74 of the material stripping assembly. The opposite end of the secondary push rod is formed with a piston end 134 and a collar 136. A cylindrical sleeve member 138 formed with a stepped cylindrical bore is coupled to one end of the primary push rod 41. Pivotally attached to the cylindrical sleeve is a locking member 140 having a handle 142 and a locking tab 144. The opposite end of the primary push rod (not shown) is coupled to the connecting rod via push rod mounts or is alternatively coupled to the lower mount of the rocker assembly (in embodiments having a counter balanced assembly). Preferably the primary and secondary are individually supported by linear bearings as shown in FIGS. 2, 4 and 9 and as discussed above to provide secure attachment to the frame.

The primary push rod is slidably engaged in the sleeve member 138, the piston end 134 being slidably engaged in the narrow portion of the bore 146 and the collar 136 being slidably engaged in the wide portion of the bore 148. The locking member as shown is pivotally attached to the sleeve member and is moveable between a locked position and an open position (shown in dashed lines). In the locked position the locking member is pivoted with its handle 142 folded flush with the surface of the sleeve member, the locking tab 144 protruding into the wide portion of the bore 148 and engaging the collar 136 thereby limiting forward motion of the push rod. Backwards motion of the push rod is limited by the junction of the narrow portion of the bore 146 and the wide potion of the bore 148, the collar being too large in diameter to pass into the narrow portion of the bore. The locking tab 144 is spaced back from the junction of the narrow portion of the bore 146 and the wide potion of the bore 148 thereby defining the usable stroke of the telescopic coupling. It is preferable that the stroke of the telescopic coupling exceeds the stroke of the material stripping assembly so that the material stripping assembly does not reciprocate back and forth.

In the open position, the locking member handle 142 is pivoted orthogonal to the surface of the sleeve member 138, the locking tab 144 retracting out of the wide portion of the bore 148 thereby allowing the secondary push rod 43 to be removed. With the locking member in the locked position, the secondary push rod is telescopically coupled to the means for reciprocation and under normal operation of the invention is repeatedly urged forward by the back and forth motion of the primary push rod and means for reciprocation.

The invention preferably uses standard AC power at 110 VAC for powering motor 14, controlled by a standard power switch (not shown). In the alternative electric power can be supplied by rechargeable batteries, such as standard lead-acid cell or Nickel Cadmium (NiCd) dry cells or the like. It is preferable that the motor be mounted low in the frame as shown in order to maintain a low center of gravity. Electric motors are ideal in that they are small and are insensitive to angular position.

In the alternative a small internal combustion engine can be used, such as a two or four stroke gasoline powered engine. Internal combustion engines are somewhat advantageous in that no electric extension cord is required and they have a relatively high power to weight ratio. However, four stroke gasoline powered engines are somewhat sensitive to position in that lubrication oil is required during engine operation. For this reason two stoke engines, which incorporate engine lubrication in the fuel mixture are less position sensitive and are more suited for use with the invention.

The invention as disclosed incorporates a mechanical means for reciprocation having a stroke defined by the offset formed in the eccentric mounts and by the mechanical advantage or disadvantage provided by the respective linkages and/or pulleys. Other specific means for reciprocation can be provided. For example, hydraulic or pneumatic cylinders can be used to vibrate or reciprocate the material stripping assembly. Alternatively an electro-mechanical means for reciprocation having an electro-magnetically driven piston, excited by an AC signal, can be used to vibrate or reciprocate the material stripping assembly. Likewise, other connections and linkages are possible, such as step-down gearing coupled between the motor and the stripping assembly.

Stripping of roofing shingles is performed as follows. An area of shingles 128 is manually removed from the roof deck 130 near the roof peak 132, thereby forming a lip under which the point of the shingle remover can be engaged. The shingle remover is positioned with the material stripping assembly pointing down the roof deck with the point engaged under this lip. The means for reciprocation is activated and the shingle remover advances down the roof. As the shingle remover moves, the roofing materials are lifted from the roof deck. Roofing nails that are encountered engage in the gap between the teeth and the nail head contacts the lifting surface. As the shingle remover is advanced further down the roof deck, the roofing nails pass rearwardly along the inclined top edge of the teeth and are wedged or lifted out of the roof deck in a direction co-axial with the nail shanks was driven into the roof deck. This minimizes the damage to the roof deck, leaving the smallest possible hole. The teeth are appropriately spaced as discussed above so that the lifting surfaces of two adjacent teeth engage under both sides of the nail head to prevent damage to the nail head and facilitate removal of the nail.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A shingle remover for removing roofing materials including nails having a shank and a head comprising:

a frame;

a handle coupled to the frame for pushing the shingle remover;

a motor coupled to the frame;

a reciprocation driver coupled to the motor, said reciprocation driver comprising a counter-shaft rotatably attached to the frame, at least one connecting rod movably coupled to a push rod, the connecting rod and push rods each having a first and second end, the push rod being movably coupled to the frame, the first end of the connecting rod being eccentrically coupled to the counter-shaft, the second end of the connecting rod being coupled to the first end of the push rod, the second end of the push rod being coupled to the material stripping assembly, and wherein the motor has at least one output shaft, which is coupled to counter-shaft and rotatably drives the counter-shaft; and a material stripping assembly movably coupled to the frame and coupled to the reciprocation driver, the material stripping assembly having a plurality of parallel teeth each formed with a point and an inclined lifting surface, the teeth being spaced apart to define parallel gaps which are larger than the diameter of the nail shank, the teeth also being spaced apart such that inclined lifting surfaces of two adjacent teeth are operable to contact at least a portion of the nail head on opposite sides of the nail shank.

2. The shingle remover of claim 1 wherein the reciprocation driver has a counter-shaft rotatable attached to the frame, two connecting rods each of which are movably coupled to a push rod, the connecting rods and push rods each having a first and second end, the push rods being movably coupled to the frame, the first ends of the connecting rods being eccentrically coupled to the counter-shaft, the second ends of the connecting rods being coupled to the first ends of the push rods, the second ends of the push rods being coupled to the material stripping assembly, the second ends of the push rods being coupled to a secondary shaft being rotatably coupled therebetween, and wherein the motor has at least one output shaft, which is coupled to counter-shaft and rotatably drives the counter-shaft.

3. The shingle remover of claim 2 wherein the counter-shaft has an axis of rotation and two eccentric mounts for attachment of the connecting rods, the eccentric mounts sharing a common eccentric axis being offset from the counter-shaft axis.

4. The shingle remover of claim 1 wherein the counter-shaft has an axis of rotation and at least one eccentric mount for attachment of the connecting rod, the eccentric mount having an eccentric axis being offset from the counter-shaft axis.

5. The shingle remover of claim 1 wherein the material stripping assembly is rigidly coupled to the second end of the push rod.

6. The shingle remover of claim 1 wherein the material stripping assembly is telescopically coupled to the second end of the push rod.

7. The shingle remover of claim 1 wherein the plurality of teeth are coupled to a mounting bar which is coupled to the reciprocation driver.

8. The shingle remover of claim 1 wherein the plurality of teeth are generally triangular in shape.

9. The shingle remover of claim 8 wherein the plurality of teeth have a first edge a second edge and a third edge, wherein the third edge forms the inclined lifting surface and the point is formed at the intersection of the first edge and the third edge.

10. The shingle remover of claim 9 wherein the plurality of teeth are coupled to the mounting bar in comb like fashion by at least one of the first and second edges.

11. The shingle remover of claim 1 further comprising a cover assembly angularly mounted to the frame at lifting angle.

12. The shingle remover of claim 1 wherein the reciprocation driver has at least one connecting rod and at least one push rod which are movably coupled to a rocker assembly having a pivot point and an upper and lower mount, the connecting rod and push rod each having a first and second end, the push rod being movably coupled to the frame, the first end of the connecting rod being eccentrically coupled to the counter-shaft, the second end of the connecting rod being coupled to upper mount of the rocker assembly, the first end of the push rod being coupled to the lower mount of the rocker assembly, the second end of the push rod being coupled to the material stripping assembly, the rocker assembly being pivotally coupled to a secondary shaft, and wherein the motor has at least one output shaft, which is coupled to counter-shaft and rotatably drives the counter-shaft.

13. A method for removing roofing shingles and nails, having a shank and a head, from a roof having a deck and a peak comprising:

providing a powered shingle remover with a reciprocating material stripping assembly having a plurality of teeth formed with a point and an inclined lifting surface, the teeth being spaced apart to define gaps which are larger than the diameter of the nail shank, the teeth also being spaced apart such that inclined lifting surfaces of two adjacent teeth are operable to contact at least a portion of the nail head on opposite sides of the nail shank, the reciprocating material stripping assembly being operably coupled to a reciprocation driver, the reciprocation driver comprising a counter-shaft rotatably attached to a frame, at least one connecting rod movably coupled to a push rod, the connecting rod and push rods each having a first and second end, the push rod being movably coupled to the frame, the first end of the connecting rod being eccentrically coupled to the counter-shaft, the second end of the connecting rod being coupled to the first end of the push rod, the second end of the push rod being coupled to the material stripping assembly, and having a motor having at least one output shaft, which is coupled to counter-shaft and rotatable drives the counter-shaft;

removing an area of shingles from a portion of the roof deck immediately below the peak thereby forming a lip under which the point of the teeth can be engaged;

positioning the shingle remover with the point of the teeth pointing towards the shingles to be removed;

engaging at least one of the points of the teeth under the lip of the shingles; and moving the shingle remover down the roof deck such that the shingles and nails are removed.

* * * * *